US009109852B1

(12) United States Patent
Boester et al.

(10) Patent No.: US 9,109,852 B1
(45) Date of Patent: Aug. 18, 2015

(54) BOWFISHING ARROW SLIDE WITH OVERMOLDED DAMPENING MEMBER ARRANGEMENT

(71) Applicant: Bear Archery, Inc., Evansville, IN (US)

(72) Inventors: Theodore J. Boester, Newburgh, IN (US); Josh Sidebottom, Chandler, IN (US)

(73) Assignee: Bear Archery, Inc., Evansville, IN (US)

( * ) Notice: Subject to any disclaimer, the term of this patent is extended or adjusted under 35 U.S.C. 154(b) by 0 days.

(21) Appl. No.: 14/533,174

(22) Filed: Nov. 5, 2014

Related U.S. Application Data

(60) Provisional application No. 61/985,128, filed on Apr. 28, 2014.

(51) Int. Cl.
*F41B 5/14* (2006.01)
*F41B 5/10* (2006.01)

(52) U.S. Cl.
CPC ..... *F41B 5/1488* (2013.01); *F41B 5/10* (2013.01)

(58) Field of Classification Search
CPC ..... F41B 5/00
USPC ..... 124/86, 23.1
See application file for complete search history.

(56) References Cited

U.S. PATENT DOCUMENTS

| | | | | |
|---|---|---|---|---|
| 2,009,252 | A * | 7/1935 | Erickson | 273/337 |
| 2,421,618 | A * | 6/1947 | Hornbeck | 446/54 |
| 2,785,458 | A * | 3/1957 | Thiry | 29/235 |
| 3,227,454 | A | 1/1966 | Ellenburg | |
| 3,614,947 | A | 10/1971 | Feldman | |
| 3,945,642 | A | 3/1976 | Henthorn, Jr. | |
| 4,846,481 | A | 7/1989 | Wageman | |
| 4,895,128 | A | 1/1990 | Okada | |
| 4,905,397 | A | 3/1990 | Juelg, Jr. | |
| 5,335,439 | A | 8/1994 | Horton | |
| 5,496,041 | A | 3/1996 | Broussard | |
| 5,553,413 | A | 9/1996 | Gannon | |
| 5,553,600 | A * | 9/1996 | Miller | 124/86 |
| 5,846,147 | A | 12/1998 | Basik | |
| 6,517,453 | B2 * | 2/2003 | LaSee | 473/578 |
| 8,852,038 | B1 * | 10/2014 | Hyde | 473/578 |
| 2010/0229845 | A1 | 9/2010 | Woods, Jr. | |

* cited by examiner

*Primary Examiner* — Gene Kim
*Assistant Examiner* — Jeffrey Vanderveen
(74) *Attorney, Agent, or Firm* — Woodard, Emhardt, Moriarty, McNett & Henry LLP

(57) ABSTRACT

Embodiments of the present disclosure include a bowfishing slide arrangement for use with an archery bow. In certain embodiments, the arrangement includes a slide having a slide body configured to slide along an arrow shaft. The arrangement further includes a stop used in cooperation with the slide. The stop is arrangeable on the arrow shaft in a manner to prevent the slide from sliding off of the arrow shaft. A dampening material is secured to the rear of the slide and arranged between the slide and the stop.

7 Claims, 6 Drawing Sheets

BOWFISHING ARROW SLIDE WITH OVERMOLDED DAMPENING MEMBER ARRANGEMENT

CROSS-REFERENCE TO RELATED APPLICATION

This application claims the benefit of U.S. Provisional Application Ser. No. 61/985,128, filed Apr. 28, 2014, which is hereby incorporated by reference in its entirety.

FIELD OF THE INVENTION

The present invention relates to archery bows and more particularly pertains to a slide arrangement for use with a bow and arrow.

BACKGROUND OF THE INVENTION

In bowfishing, a fishing line is attached to the arrow that is projected at a target, allowing the arrow and any connected targets to be retrieved after firing. In certain arrangements, the line is attached to the arrow by an arrow slide arrangement that helps prevent the line from interfering with or becoming tangled with parts of the bow while the arrow is being drawn and released.

SUMMARY OF THE INVENTION

Figure 1:
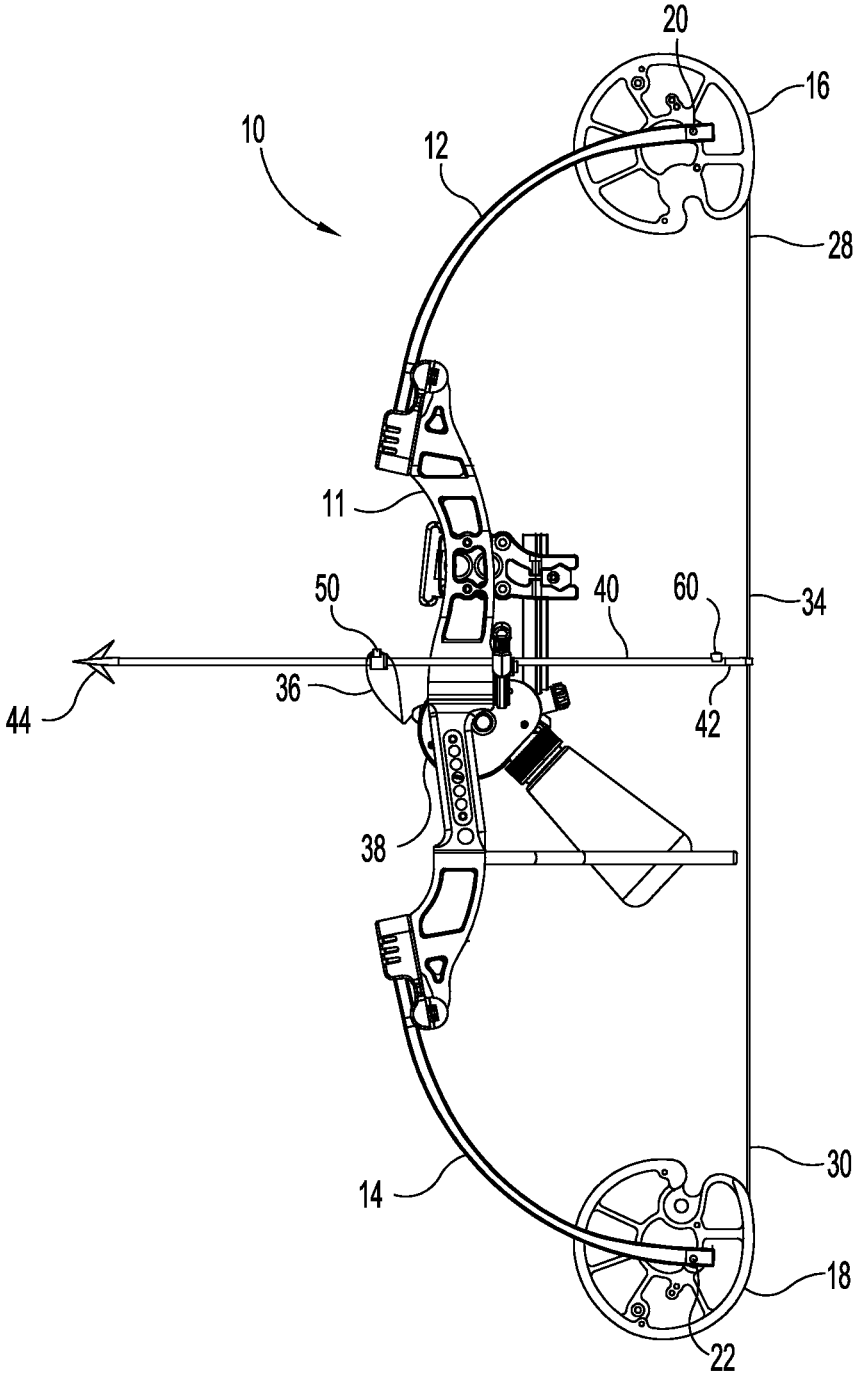
FIG. 1 is a side view of an archery bow in an undrawn position incorporating a bowfishing arrow slide arrangement according to a preferred embodiment of the present disclosure.

Bowfishing arrangements according to certain embodiments described herein include bowfishing slide apparatuses configured for use with archery bows. In typical embodiments, an archery bow includes a bow body with a riser and upper and lower limbs. A bowstring extends between the upper and lower limbs.

An arrow is equipped with a slide assembly and a stop near the rear of the arrow shaft. The slide assembly includes a slide body configured to slide along the arrow shaft. The stop may be arranged on the arrow shaft in a manner to prevent the slide assembly from sliding off of rear of the arrow shaft. A circular dampening portion is arranged in a ring overmolded on a flange on the rear of the slide facing the stop. In certain embodiments, the dampening portion material is mounted to the flange with a chemical adherence bond formed by the heat of the overmolded material slightly melting and mixing with the surface of the flange. Preferably, the slide body can freely rotate around said arrow shaft, so that the area of impact between the circular dampening portion and the stop varies so that wear on the dampening portion is distributed over different portions of the ring. The frequently changing area of impact reduces wear on the dampening portion as the wear is distributed over different portions of the ring. Further, the dampening portion defines a relatively broad rearward facing circular impact face which spreads and dilutes the impact force across the front and partially around the sides of the stop.

In certain specific embodiments, the slide body defines one or more attachment points and an interior passage. The dampening portion also defines an interior passage and translates with the slide. The passages allow the slide body and dampening portion to translate along portions of the arrow shaft. A fishing line may be secured to the slide. The other end of the fishing line may be secured to the bow, for example to a reel secured to the bow body. As the slide moves rearward when the arrow is released, the dampening portion impacts the stop.

Other objects and attendant advantages will be readily appreciated as the same become better understood by references to the following detailed description when considered in connection with the accompanying drawings.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the invention relates.

Embodiments disclosed herein include a cooperating bowfishing arrow slide and stop arrangement for use with an archery bow. In certain configurations, a slide is arranged on an arrow shaft and a fishing line is connected to the slide. When a bow and arrow are in a drawn position, the slide is located at or near the front of the arrow. As the arrow is fired, the arrow slides through the slide until the slide contacts a stop located near the rear of the arrow, after which the fishing line trails the arrow and is pulled. A dampening portion, for example made of a rubber material, is arranged on the rear of the slide towards the stop. The rubber portion translates with the slide.

FIG. 1 illustrates an example of a conventional dual cam compound bow generally designated 10. Bow 10 is described for illustration and context and is not intended to be limiting. When viewed from the perspective of an archer holding the bow, it includes a riser 11 with a handle, an upper limb portion 12, and a lower limb portion 14 forming a bow body. In the dual cam bow example illustrated, rotational members such as cams 16 and 18 are supported at the limb tip sections for rotary movement about axles 20 and 22. In the embodiment shown, upper and lower limbs are formed of parallel and symmetric limb portions sometimes called quad limbs. Alternately, a single piece limb can have a notch or slot area removed to allow a rotational element to be mounted to the limb tip. An upper pulley axle 20 is carried between the outer limb tip portions of upper limb 12. A lower pulley axle 22 is carried between the outer limb tip portions of lower limb 14.

The portion of the cable which defines the bowstring cable 34 includes an upper portion 28 and a lower end portion 30 which are fed out from cams 16 and 18 when the bow is drawn. The non-bowstring portions of the cable arrangement including return or cross cables extending between the cams and/or limb tips are not illustrated for ease of reference. Each cable has a thickness and one or more strands forming a round cross-section defining a circumference.

From the perspective of the archer, the bowstring is considered rearward relative to the riser which defines forward. Directional references herein are for ease of explanation and are not intended to be limiting. Similarly, a bow riser held with the left hand is illustrated, but is not intended to be limiting. A symmetric arrangement can be used with a bow having a right-handed riser.

When the bowstring 34 is drawn, it causes cams 16 and 18 at each end of the bow to rotate, feeding out cable and bending limb portions 12 and 14 inward, causing energy to be stored therein. When the bowstring 34 is released with an arrow engaged to the bowstring, the limb portions 12 and 14 return to their rest position, causing cams 16 and 18 to rotate in the opposite direction, to take up the bowstring 34 and launch the arrow with an amount of energy proportional to the energy initially stored in the limbs.

Certain embodiments can also be used with single or hybrid cam compound bows. A single cam bow includes a similar riser with a handle, upper limb portions, and lower limb portions. Rotational members such as an upper idler wheel and a lower eccentric cam are supported at the limb tip sections for rotary movement about their axles. A bowstring cable includes an upper end fed-out from the upper wheel and a lower end mounted to an fed-out from the lower cam when the bow is drawn. A return cable portion has an upper end wrapped around the upper cam and a lower end mounted to the lower cam, with the lower end fed-out from the cam as the bow is drawn. Additionally, a y-yoke anchor cable has a lower end mounted to the lower cam and two upper ends mounted to the axle of the upper cam. The lower end is taken in to the lower cam as the bow is drawn. References herein to a bowstring or cable portion extending to the limb tips are intended to broadly include a cable portion wrapped around or mounted to a track of a rotational element or an attachment to an axle mounted at the limb tips.

The present disclosure can also be used in other types of bows, for example recurve bows, hybrid cam bows, or crossbows, all of which are considered conventional for purposes of the present disclosure. For convenience, the combination of riser 11 and either single or quad limbs forming upper limb 12 and lower limb 14 may generally be referred to as a bow body. It should be appreciated that a bow body can take on various designs in accordance with the many different types of bows. Similarly, a bowfishing arrangement can take on a variety of designs by adding a line or reel to any of the various bow body types.

In some variations, as illustrated in FIGS. 1-8, an arrow is included in the bowfishing arrangement and includes a shaft 40, a nock 42, and a point 44. The point is at the forward end of the shaft and the nock is at the rear and is adapted to engage with a bowstring. The arrow also includes a slide assembly or slide 50 and stop 60. The stop 60 is located along the rearward portion of shaft 40 near or part of nock 42. The slide 50 includes a slide body or a sliding portion 51 with an interior surface defining an interior passage 52 allowing the slide body 51 to slide along the arrow shaft 40. Stop 60 prevents the slide assembly from sliding off the rear of the shaft 40. A dampening portion 70, for example made of rubber, is arranged on the rear of the slide facing stop 60.

Figure 2:
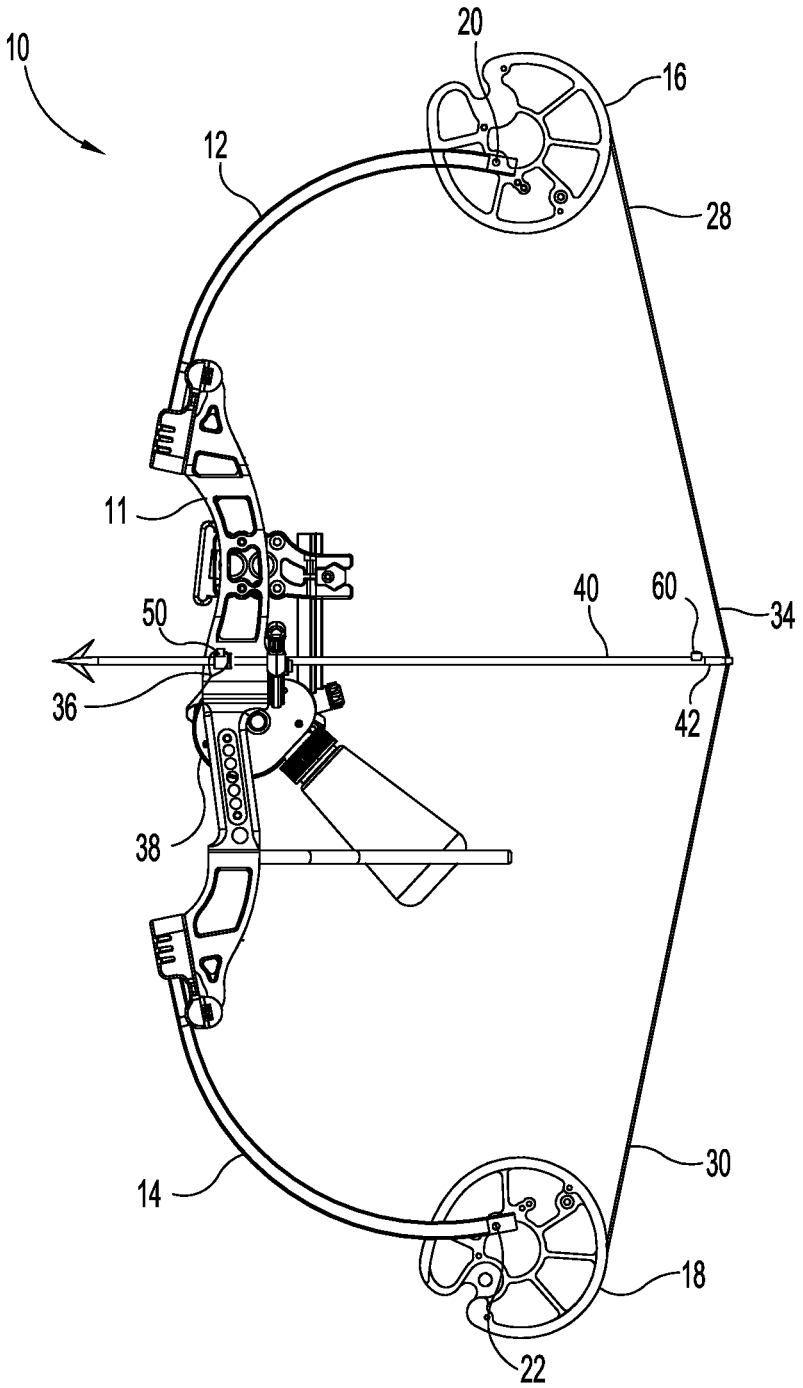
FIG. 2 is a view of the bow of FIG. 1 in a drawn position.
Figure 3:
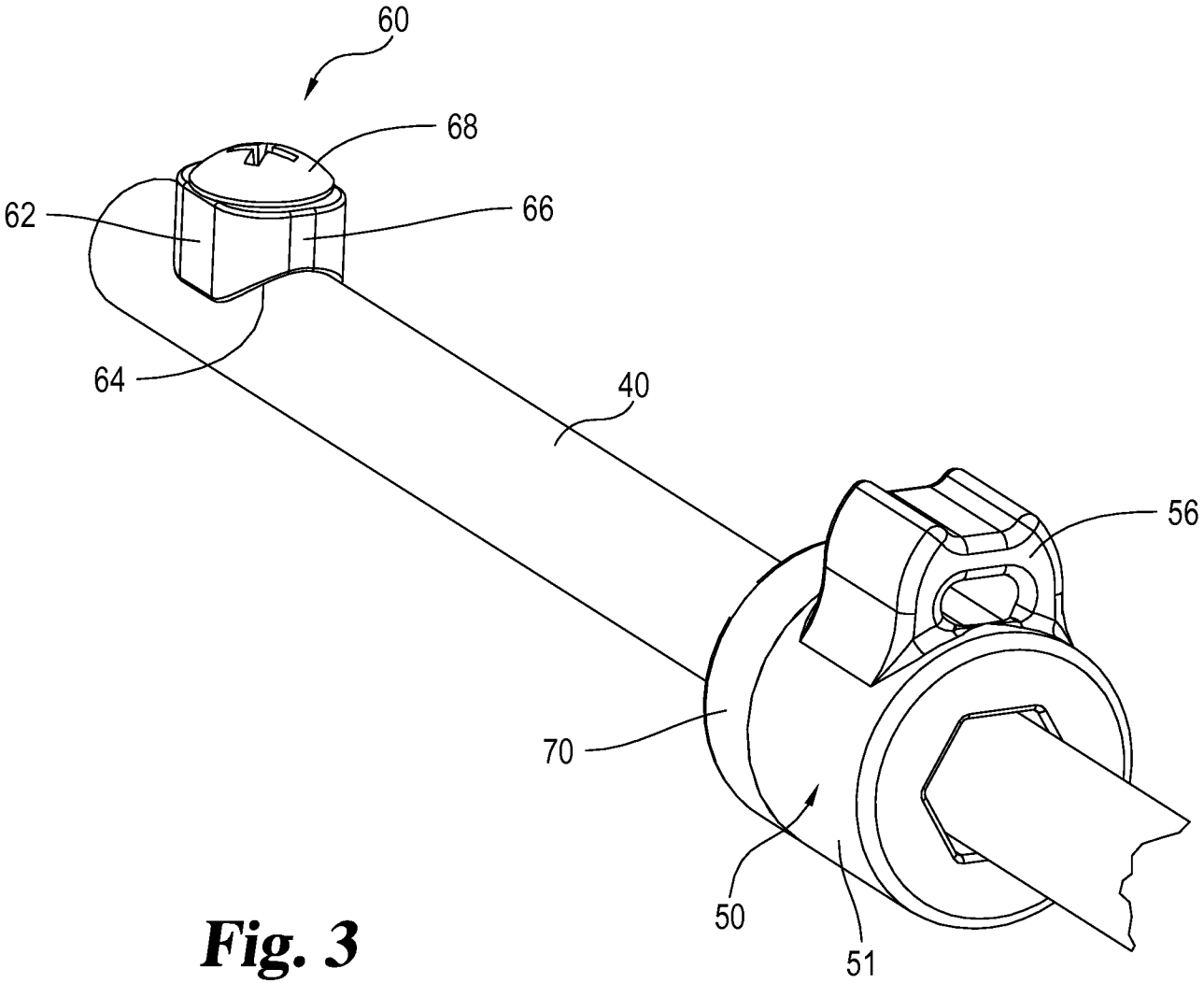
FIG. 3 is a perspective view of a bowfishing arrow slide arrangement in place on an arrow shaft.
Figure 4:
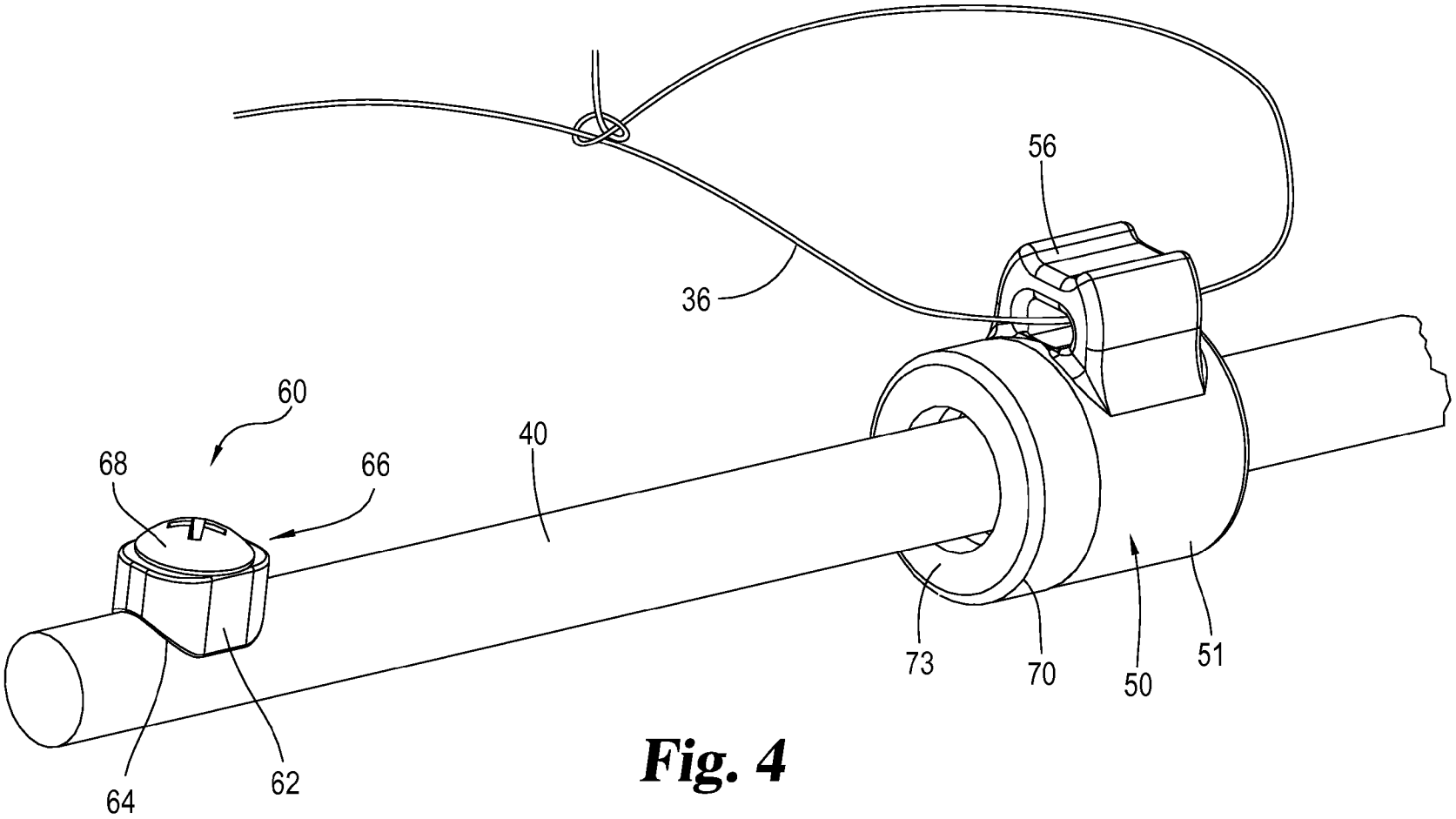
FIG. 4 is another perspective view of a bowfishing arrow slide arrangement in place on an arrow shaft.
Figure 5:
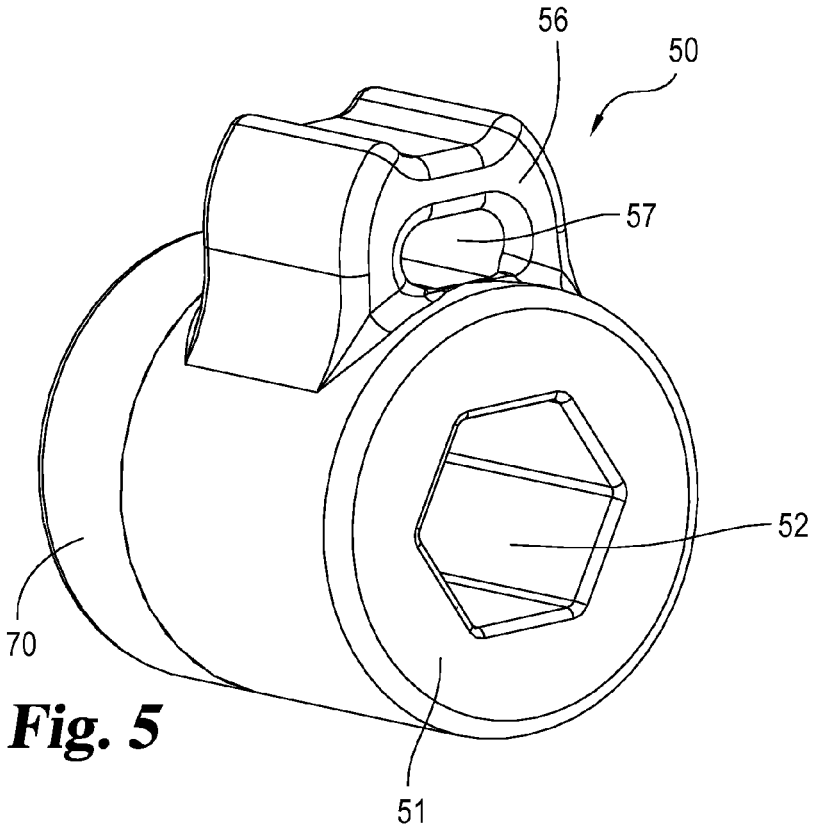
FIG. 5 is a perspective view of an arrow slide suitable for use in a bowfishing arrow slide arrangement of the present disclosure.
Figure 6:
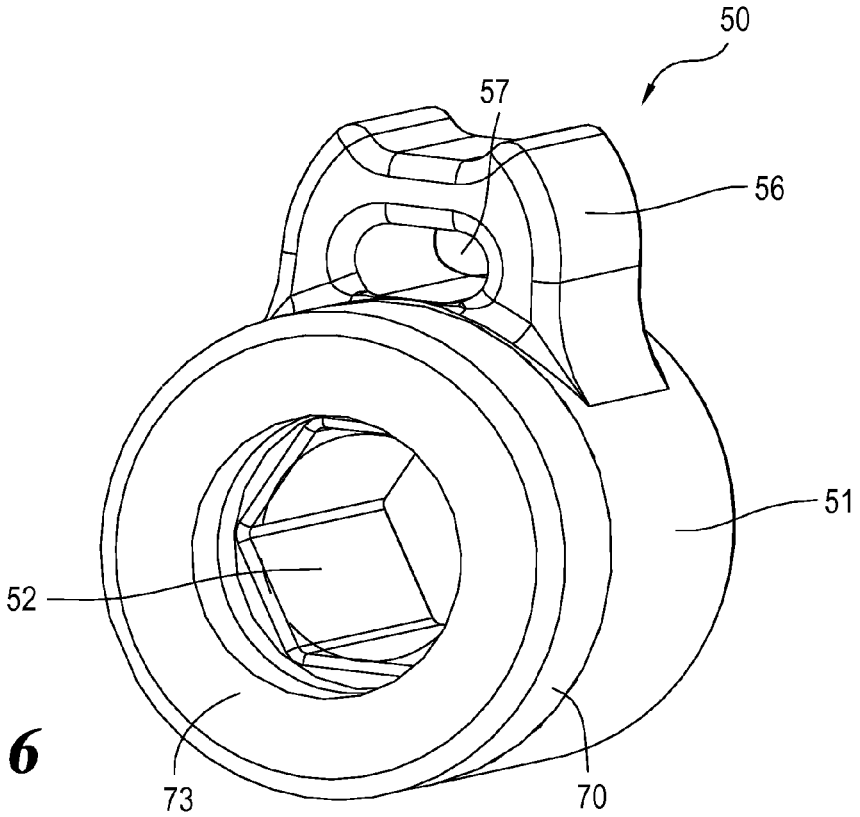
FIG. 6 is an alternate perspective view of the arrow slide of FIG. 6.
Figure 7:
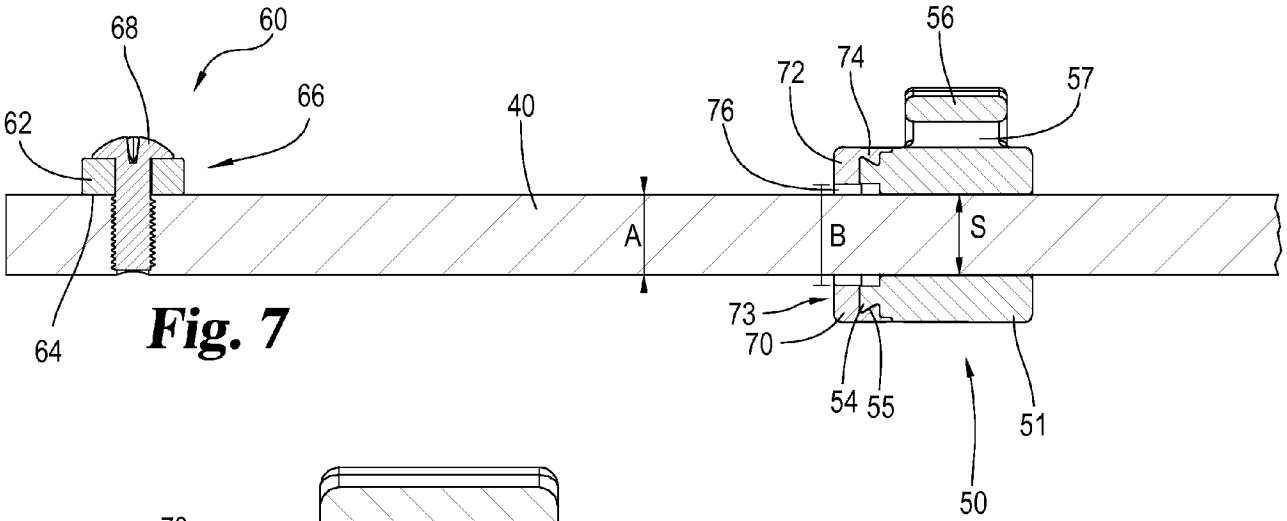
FIG. 7 cross-sectional view of the arrow slide arrangement of FIG. 3.
Figure 8:
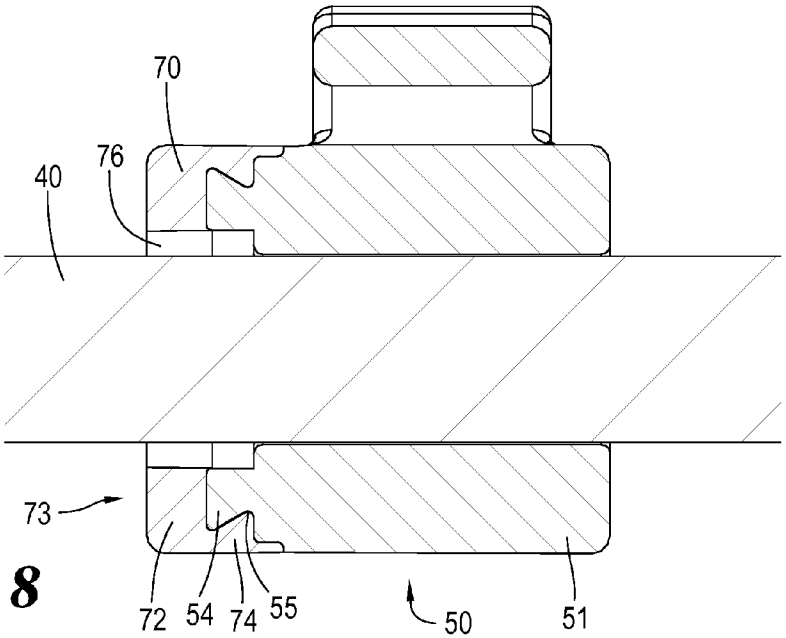
FIG. 8 is an enlarged cross-sectional side view of the arrow slide of FIG. 3.

As illustrated for example in FIG. 4, a fishing line 36 can preferably be secured to an attachment portion 56 on slide 50. For example, fishing line 36 may pass through an attachment passage 57 and then be tied to itself to form a loop. Optionally, the loop may be long enough to extend behind the rear of the arrow when the slide 50 is arranged on an arrow shaft and the slide 50 abuts the stop 60. For example, when pulled the loop may define a length or a distance which extends from the slide body 51 along a straight line axis to behind the arrow. Optionally yet preferably, the loop can freely slide with respect to slide 50 and passage 57 to balance the fishing line's pull or drag on the slide. The other end of the fishing line 36 may be secured to a bow 10, for example by connecting to a reel 38 mounted to bow body, as seen in FIGS. 1-2. Although reel 38 is illustrated below the arrow shaft 40, in other arrangements the reel 38 may be mounted above the plane where the arrow shaft 40 is drawn and released.

In certain arrangements, some or all of the exterior of the slide body 51 approximates the shape of a cylinder, or a truncated cone, truncated pyramid, or other form of frustum. The form may have a variety of different base shapes. As examples, the form may be circular, elliptic, or polygonal in cross-section. In one specific example, all or a substantial portion of the sliding portion 51 may be frusto-conical in shape. In some configurations, a conical shape improves aerodynamics of the slide and permits truer flight of the arrow.

In certain embodiments, the interior passage 52 has a generally cylindrical or hexagonal cross-section with an inner diameter that is approximately equal to yet slightly larger than the outer diameter of the shaft 40 enabling slide 50 to freely slide on shaft 40. For purposes of illustration only, the arrow shaft 40 may define a shaft outer diameter A of approximately 0.3125 inches, while the slide defines an inner diameter S of approximately 0.32 inches. The interior passage 52 may be shaped differently in other embodiments.

In some variations, slide 50 may be freely rotatable around the arrow shaft 40. For example, the slide body 51 may have a substantially cylindrical interior passage 52 or a passage with a sufficient inner diameter S that allows the slide body 51 to rotate around an arrow shaft. Allowing rotate reduces binding or dragging force between the slide body 51 and arrow shaft 40 and also allows the area of impact between the circular dampening portion and the stop to vary with different shots of the arrow. The change in the area of impact reduces wear on the dampening portion as the wear from different impacts is distributed over different portions of the ring.

Preferably there is minimal translational friction between slide 50 and the arrow shaft 40. In some forms, at least the portions of the slide body 51 in contact with an arrow shaft may be formed from self-lubricating materials, such as Delrin® plastic to give one non-limiting example. Alternatively, interior passage 52 of the slide body 51 may be lubricated or it may be coated with low friction materials, such as a Teflon® coating, to reduce friction. In some forms, an arrangement of alternating recessed portions and raised portions may reduce the surface area of the interior passage 52 in contact with the arrow shaft 40 and reduce friction between the slide body and the shaft 40. According to other arrangements, the slide 50 may include wheels, bearings, or other rotational elements in contact with an arrow shaft that reduce friction between the shaft and the slide.

In certain embodiments, slide 50 includes a dampening portion 70, for example made of a rubber material, arranged on the rear of the slide body facing the stop. The dampening portion 70 translates with slide body 51. The dampening portion defines an impact face 73 facing rearward or toward stop 60. When the slide travels rearward, it serves as a bumper when impact face 73 contacts stop 60. The dampening portion is preferably made from a material to dampen the impact force between slide 50 and stop 60 when the arrow is fired from a bow. Example dampening materials include rubber, urethane, silicone or a thermoplastic elastomer. One specific example of a suitable elastomer material is sold by Teknor Apex under the name SARLINK® TPV 3160.

Preferably the dampening portion/material is secured to the rearward side of slide body 51. In the illustrated embodiment, slide body 51 defines a flange 54 on the rearward face. As illustrated in detail in FIGS. 7-8, flange 54 is ring shaped and tapers outward and rearward from a defined groove 55. Dampening portion 70 includes a body 72 of dampening material. Body 72 extends to an engaging portion 74 which extends around and over flange 54 and into groove 55. Preferably, engaging portion 74 securely mounts the dampening material to slide body 51. Optionally yet preferably, the outer diameter of dampening portion 70 is flush with the outer diameter of slide body 51.

Dampening portion 70 encircles shaft 40 with an interior surface defining an interior passage 76, allowing the damping portion 70 to slide along the arrow shaft 40. Dampening portion 70 is arranged to travel or translate with slide body 51 as slide 50 translates along shaft 40. Preferably, the dampening portion is arranged to not bind or cause friction between the slide and the shaft during sliding motion. In certain embodiments, dampening portion 70 defines an inner bumper diameter B which is greater than the outer diameter A of shaft 40 and greater than the inner diameter S of passage 52 in slide body 51. The dampening material is preferably spaced from the arrow shaft to prevent increased drag that would be created by contact.

In certain embodiments, dampening portion 70 is formed by overmolding a dampening material onto flange 54. For example, a slide body 51 is placed in a mold cavity with the mold defining a void in the area where dampening portion 70 is to be formed. Then a hot liquid material, such as liquid rubber, is injected into the mold to fill the void. The void directs the liquid material around the slide body, flange 54 and into groove 55 and fills the area to form body 72. The material is then cooled and slide 50 is removed from the mold. Preferably, the engagement of the dampening material with flange 54 secures the dampening portion to slide body 51. Optionally yet preferably, the heat of the injected liquid or an alternate heating step slightly melts the surface of flange 54 and the exposed surfaces of slide body 51 so that the dampening material and slide body slightly intermix, forming a chemical adherence bond.

Alternately, the dampening material can be secured to slide body 51 using adhesives or fasteners. In other embodiments, the dampening material forms a friction fit with slide body 51, for example around flange 54.

As illustrated, the stop 60 is located at or near the rear of shaft 40, rearward of slide 50. Stop 60 has a height and width sufficient to prevent the slide assembly from sliding off the rearward end of the arrow shaft. Stop 60 defines an impact face 66 arranged forward or facing toward slide 50. In a ring arrangement, the dampening portion defines a rearward facing circular impact face which is wider than the width of stop 60. In use, the width of the circular impact face spreads the impact force across the front of stop impact fact 66 and partially around the sides of the stop, creating a broad surface area of engagement between the dampening portion and the stop to facilitate the dampening function and spreading any wear and tear to dilute it across the surface area.

In the illustrated embodiment, stop 60 is formed with a stop body 62 secured to shaft 40 by a fastener 68. In the illustrated embodiment, fastener 68 is a threaded screw which extends through stop body 62 into shaft 40. In alternate embodiment, other types of fasteners such as a pin or rivet can be used. Alternately, stop 60 can be adhered to shaft 40, for example using an adhesive or another form of bond. In some possible variations, the stop 60 is integrally made as part of a shaft or incorporated into a nock. Optionally, fletchings may be included between the nock 42 and the stop 60.

In certain preferred embodiments, stop body 62 is rigid and/or made from a substantially rigid material such as a rigid plastic. As one non-limiting example, the stop can be made from a rigid nylon plastic material, specifically a DuPont® material sold under the name ZYTEL® ST801. It should be appreciated that the stop 60 may be formed and/or configured differently, including but not limited to incorporating a resilient material.

Slides according to various embodiments envisioned herein may be used with arrow shafts formed from a variety of materials, including but not limited to wood, aluminum, carbon fiber, composites, or combinations thereof. Attachment of an optional arrowhead or point 44 to forward end 45 can be accomplished in a variety of ways known to those of skill in the art, including with a threaded shaft, adhesives, caps, tangs, or hafting, and all are contemplated in the disclosure.

In use, a bowfishing archery bow may be used to shoot an arrow. With a bow, an arrow, a stop near the rear of the arrow, a slide on the shaft of the arrow, and a fishing line attached to the slide at one end with the other end secured to the bow, the nock of the arrow is placed adjacent to the bowstring in an undrawn position. As the bowstring and arrow are pulled rearward, drag on the slide allows the shaft to pass through the slide so that the slide and the fishing line may remain substantially in front of the riser.

Once the bow is drawn, the bent limbs of the bow body store energy. When the bowstring is released, the limbs return to their original position and kinetic energy is transferred to the arrow. As the arrow is projected forward, it moves faster than and through the slide, relatively translating the slide towards the rear of the arrow. When the slide reaches the stop, the fishing line is pulled by the arrow substantially along the trajectory of the arrow. Optionally yet preferably, the fishing line can be used to retrieve the arrow and any items attached thereto.

While the invention has been illustrated and described in detail in the drawings and foregoing description, the same is to be considered as illustrative and not restrictive in character, it being understood that only the preferred embodiments have been shown and described and that all changes and modifications that come with the spirit of the invention are desired to be protected.

What is claimed:

1. A bowfishing apparatus, comprising:

an arrow shaft having an outer diameter and defining a forward end and a rearward end;

a slide assembly having a plastic slide body portion defining an interior passage with an inner diameter around said arrow shaft, allowing said slide body to freely translate along the arrow shaft;

said slide body having an attachment portion defining an attachment passage allowing a fishing line to be secured to said slide assembly;

said slide body defining a ring-shaped circular flange on the rearward face of said slide body and around said arrow shaft, wherein said flange tapers outward and rearward such that it increases in outer diameter as it moves away from the rearward face to form a defined groove between the rearward face and the rearward most portion of said circular flange;

said slide assembly having a circular dampening portion made of an elastomer material different than the material of said slide body mounted to and completely covering said circular flange of said slide body and filling said defined groove to form a ring around said arrow shaft, said dampening portion defining a rearward facing circular impact face, said circular dampening portion defining an inner diameter which is greater than the diameter of said interior passage of said slide body so as to not contact said arrow shaft and an outer diameter which is no greater than the outer diameter of the rearward face of said slide body, said circular damping portion being chemically adhered to said circular flange;

said dampening portion arranged to translate with said slide body as said slide assembly translates along said arrow shaft; and, a rigid stop secured in a non-moving position adjacent a rearward portion of said arrow shaft, said rigid stop having a height and width sufficient to prevent the slide assembly from sliding off the rearward end of the arrow shaft.

2. The bowfishing apparatus of claim 1, wherein dampening portion material is overmolded to said flange via injection molding with a chemical adherence bond between said slide body and said dampening portion formed by the heat of the injected material slightly melting and mixing with the surface of said flange.

3. The bowfishing apparatus of claim 1, wherein said dampening portion is injection molded around and over said flange and into the groove.

4. The bowfishing apparatus of claim 1, wherein said slide body passage allows said slide assembly to freely rotate around said arrow shaft.

5. The bowfishing apparatus of claim 4, wherein said slide body passage has a hexagonal cross-section.

6. The bowfishing apparatus of claim 1, wherein the stop is made of a rigid nylon plastic material.

7. The bowfishing apparatus of claim 6, wherein said dampening portion is made of a thermoplastic elastomer.

* * * * *